US006971235B2

(12) United States Patent
Langenfeld et al.

(10) Patent No.: US 6,971,235 B2
(45) Date of Patent: Dec. 6, 2005

(54) EVAPORATIVE BURNER

(75) Inventors: Christopher C. Langenfeld, Nashua, NH (US); Ryan Keith LaRocque, Pepperell, MA (US); Angus A. MacEachern, Acton, ME (US); Michael G. Norris, Manchester, NH (US)

(73) Assignee: New Power Concepts LLC, Manchester, NH (US)

( * ) Notice: Subject to any disclaimer, the term of this patent is extended or adjusted under 35 U.S.C. 154(b) by 0 days.

(21) Appl. No.: 10/775,035

(22) Filed: Feb. 9, 2004

(65) Prior Publication Data

US 2004/0177611 A1 Sep. 16, 2004

Related U.S. Application Data

(63) Continuation-in-part of application No. 10/382,089, filed on Mar. 5, 2003, now Pat. No. 6,708,481.

(60) Provisional application No. 60/365,657, filed on Mar. 19, 2002.

(51) Int. Cl.[7] ..... F02G 1/04
(52) U.S. Cl. ..... 60/517; 60/526
(58) Field of Search ..... 60/517, 526; 431/326–329, 431/258–266, 298–325

(56) References Cited

U.S. PATENT DOCUMENTS

| | | | | |
|---|---|---|---|---|
| 3,775,973 A | | 12/1973 | Hudson | |
| 3,798,901 A | | 3/1974 | Lewenhaupt | |
| 4,008,039 A | | 2/1977 | Compton et al. | |
| 4,067,191 A | | 1/1978 | Gronvall et al. | |
| 4,105,395 A | * | 8/1978 | Goodnight et al. | 431/351 |
| 4,231,222 A | | 11/1980 | Fenton | |
| 4,364,724 A | | 12/1982 | Alpkvist | |
| 4,615,173 A | | 10/1986 | Usui et al. | |
| 4,633,667 A | * | 1/1987 | Watanabe et al. | 60/517 |
| 5,065,579 A | | 11/1991 | Monahan | |
| 5,158,261 A | | 10/1992 | Morohoshi | |
| 5,590,526 A | | 1/1997 | Cho | |
| 5,954,039 A | | 9/1999 | Doering et al. | |
| 6,027,334 A | * | 2/2000 | Blaschke | 431/261 |
| 6,220,030 B1 | * | 4/2001 | Clucas et al. | 60/517 |
| 6,247,310 B1 | | 6/2001 | Norris et al. | |
| 6,302,080 B1 | | 10/2001 | Kato et al. | |
| 6,708,481 B2 | * | 3/2004 | Kamen et al. | 60/517 |
| 6,726,114 B2 | * | 4/2004 | Blaschke et al. | 431/168 |

FOREIGN PATENT DOCUMENTS

| | | | | |
|---|---|---|---|---|
| DE | 12 77 499 B | | 9/1968 | |
| DE | 3446788 A | * | 7/1986 | F23D 17/00 |
| DE | 41 13 067 A1 | | 10/1992 | |
| DE | 100 07 164 A1 | | 8/2000 | |
| EP | 0 454 351 A2 | | 10/1991 | |
| JP | 04347410 | | 12/1992 | |
| JP | 06185706 A | * | 7/1994 | F23D 11/08 |
| JP | 09015197 | | 1/1997 | |

* cited by examiner

*Primary Examiner*—Sheldon J Richter
(74) *Attorney, Agent, or Firm*—Bromberg & Sunstein LLP

(57) ABSTRACT

An evaporative burner that includes an igniter assembly, a swirler, an evaporation chamber, and a reverse throat. The reverse throat has raised ends that protrude into the evaporation chamber. The reverse throat in combination with the evaporation chamber and the swirler, facilitate the recirculation of air in the evaporation chamber such that a flame is stabilized near the evaporation chamber walls. This flame gradually evaporates the fuel in the lining of the evaporation chamber. The fuel-air mixture results in a steady and uniformly distributed flame in the combustion chamber. This flame can heat uniformly the walls of the combustion chamber, and thus be applicable for high efficiency and low emissions applications. Furthermore, this burner can start and reach full burner power rapidly.

19 Claims, 5 Drawing Sheets

EVAPORATIVE BURNER

CROSS REFERENCE TO RELATED APPLICATIONS

The present application is a U.S. continuation-in-part patent application of U.S. patent application Ser. No. 10/382,089, filed on Mar. 05, 2003 now U.S. Pat. No. 6,708,481, entitled "FUEL INJECTOR FOR A LIQUID FUEL BURNER," which is incorporated herein by reference in its entirety, which claims priority from U.S. provisional patent application, Ser. No. 60/365,657, filed Mar. 19, 2002, entitled "FUEL INJECTOR FOR A LIQUID FUEL BURNER," which is incorporated herein by reference in its entirety.

TECHNICAL FIELD AND BACKGROUND ART

External combustion machines, for example Stirling cycle machines, including engines and refrigerators, have a long technical heritage. Walker, *Stirling Engines*, Oxford University Press (1980), describing Stirling cycle engines in detail, is incorporated herein by reference. The principle underlying the Stirling cycle engine is the mechanical realization of the Stirling thermodynamic cycle: isovolumetric heating of a gas within a cylinder, isothermal expansion of the gas (during which work is performed by driving a piston), isovolumetric cooling, and isothermal compression.

A burner for an external combustion engine such as a Stirling cycle engine should have a high thermal efficiency, low emissions, good cold starting capabilities and a large turndown ratio or wide dynamic range. High thermal efficiency may be achieved by capturing the thermal power in the hot exhaust exiting the Stirling heater head at about 900° C. Typically, this thermal power is captured by preheating the incoming combustion air in a recuperative heat exchanger. The preheated air typically enters the fuel mixing section at 500 to 800° C. Low emissions in liquid fuel burners are best achieved by pre-vaporizing and premixing the liquid fuel with the air before the mixture reaches the combustion zone in the burner. In addition to producing high efficiency and low emissions with preheated air, the burner must be capable of being ignited and warmed-up with ambient temperature air. Last, a burner should be able to power up relatively quickly and be capable of good fuel/air mixing and flame stabilization over a wide range of air temperatures and fuel flows.

The relatively low burner power level required in a <3 kWe (kilowatt electric) Stirling engine provides an additional challenge to burner design. Most liquid fuel furnaces evaporate the fuel and mix it with air by atomizing the fuel into a fog of droplets that readily evaporate and mix with the combustion air. Atomization is usually achieved by forcing the liquid fuel through a small hole with significant pressure. However, such an approach is limited to burner powers above 12 kWt (kilowatt thermal) and thus engines above 3 kWe. Below this flow rate, good atomization requires impracticably small holes.

One solution to both premixing the fuel and operating at very low power levels is an evaporative burner. In such a burner, fuel evaporates from a fuel-soaked wick that is arranged near the combustion chamber to absorb some of the heat of the combustion. Electrically powered evaporative burners are ignited with a glow plug that evaporates and ignites a small amount of fuel. This initial flame spreads over the evaporative surfaces and supports the continuous evaporation of fuel. The flame near the evaporative surface is typically very rich and complete combustion occurs downstream.

Existing designs do not address the needs of a compact, high efficiency and low emissions of external combustion engine such as Stirling cycle engine and the capability to preheat the air without detrimental effects. An important factor absent in the traditional burners may be the uniform heating of the heater head. A burner that provides a uniform flame to the heater head surfaces can improve engine efficiency and power.

Other important factors include the ability to reach full burner power after ignition in a short period, and the generation of less smoke and emissions.

SUMMARY OF THE INVENTION

Accordingly, an improved evaporation burner is provided. Certain embodiments of this evaporative burner are capable of igniting over a wide temperature range and reaching full burner power in a relatively short time. Furthermore, other embodiments of the evaporative burner, due to the gradual evaporation of fuel, provide heat uniformly to the heater head surfaces in the combustion chamber.

The evaporative burner comprises a swirler, an evaporation chamber, an igniter assembly, and a reverse throat. Embodiments of the burner may further comprise a combustion chamber, a recuperative heat exchanger, a flame rectification monitoring device and a means for varying the temperature of the feed fuel.

The burner may include a circumferential limiting wall with a socket to accommodate an igniter assembly. The igniter assembly with an air and fuel port, for igniting a fuel-air mixture in the evaporative chamber, is coupled to the evaporation chamber with at least an igniter open into the chamber. The igniter assembly may be lined with a screen to help distribute the fuel in the assembly. The igniter ignites to create an ignition flame that may initially evaporate fuel in the evaporation chamber.

In embodiments of the invention, the back limiting wall of the burner includes a swirler to direct air into the burner. In such embodiments, the swirler may have vanes with certain dimensions to direct the optimal flow of air into the evaporation chamber and the combustion chamber and the inside walls of the evaporation chamber may be lined to facilitate the uniform distribution of the fuel in the chamber. Additionally, the evaporation chamber may be separated from the combustion chamber by a reverse throat with raised ends such that the raised ends of the reverse throat protrude into the evaporation chamber.

Certain embodiments of the invention include an evaporative burner system where the evaporative burner is used with an external combustion heat engine. Other specific embodiments of the invention include an evaporative burner system where the evaporative burner used with a Stirling cycle engine.

Other embodiments of the evaporative burner include a flame rectification monitoring device. The flame rectification monitoring device may be used with any gaseous or liquid burner. In this embodiment, the monitoring device may use the flame rectification method and the associated control unit and flame rod to provide a signal in the presence of a flame.

Other embodiments of the burner include a recuperative heat exchanger such as a preheater. The preheater may heat the air entering the evaporation chamber. The heated air may mix with the evaporated fuel to form the optimal fuel-air mixture to sustain a flame.

Other embodiments of the burner are the optimal dimensions of the igniter assembly air port as correlated to the dimensions of the reverse throat and swirler ends, required to balance the air flow through the igniter assembly air port and the air directed by a swirler, such that the Fuel-Air Equivalence (FAE) is about 2 to about 6 in the igniter.

In accordance with other embodiments of the invention, the dimensions of the ignition assembly air port is correlated to the dimensions of the reverse throat and swirler, to balance air flow through an igniter assembly air port and the air directed by a swirler such that an exiting velocity of a flame from the igniter into the evaporation chamber is about 40 to about 120 cm/sec.

In accordance with other embodiments of the evaporative burner, the initial temperature of the fuel varies from the final temperature of the fuel delivered to the burner. The temperature variation may be effected by a temperature varying means such as a water, air or gas-cooling method. In a specific embodiment, the fuel to the igniter assembly is water-cooled.

BRIEF DESCRIPTION OF THE DRAWINGS

The foregoing features of the invention will be more readily understood by reference to the following detailed description, taken with reference to the accompanying drawing(s), in which.

DETAILED DESCRIPTION OF EMBODIMENTS

Definitions. As used in this description and the accompanying claims, the following terms shall have the meanings indicated, unless the context otherwise requires:

FAE: Fuel-Air Equivalence (FAE) ratio= Actual Fuel-Air Mass Ratio/Stoichiometric Fuel-Air Mass Ratio.

Figure 1:
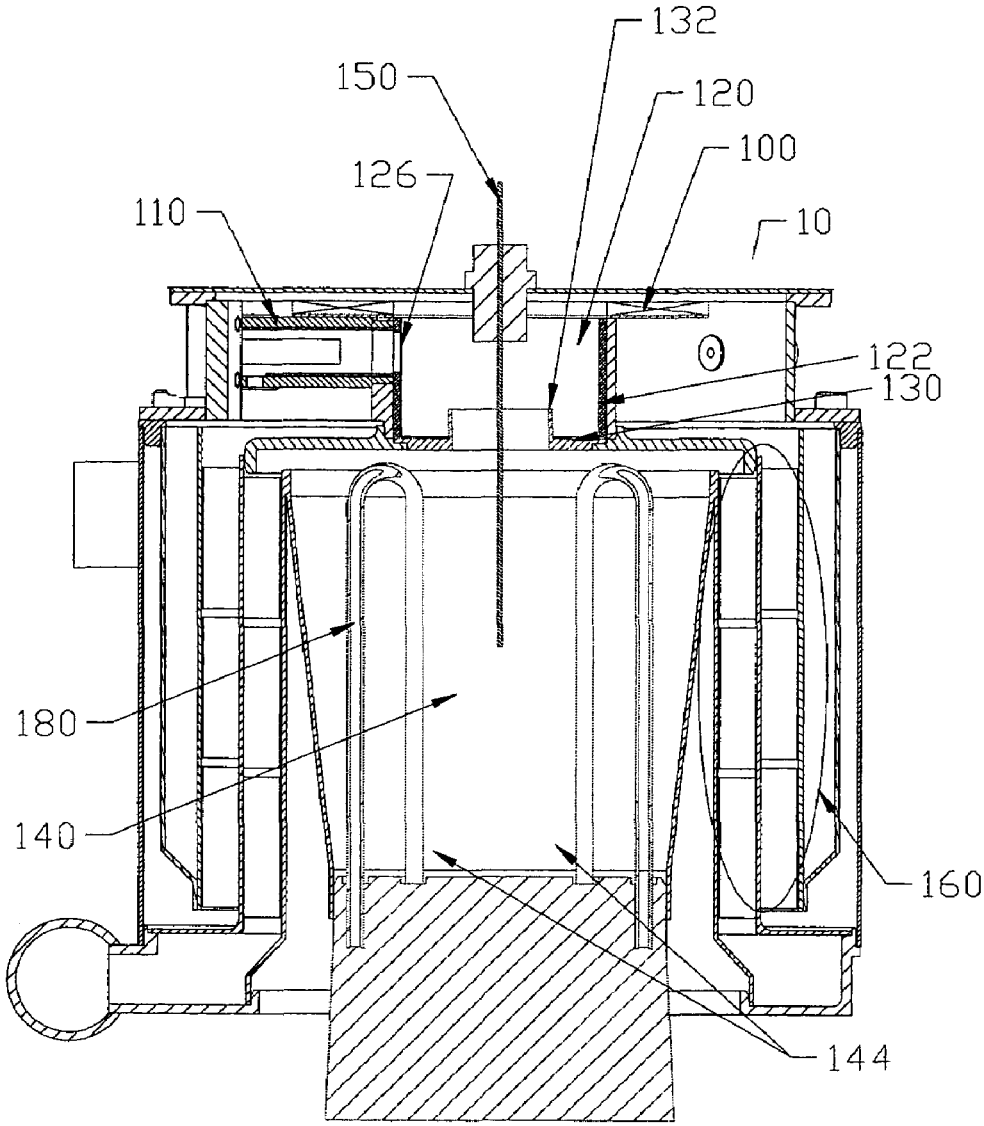
FIG. 1 shows a cross sectional view of the evaporative burner.

FIG. 1 illustrates an embodiment of the invention in the exemplary application for providing heat uniformly to the walls of a combustion chamber. While embodiments of the invention will be described generally with reference to an external combustion engine such as a Stirling cycle engine, it is to be understood that many engines, burners, and other machines may similarly benefit from various embodiments and improvements that are subjects of the present invention. It also understood that liquid fuel includes pumpable hydrocarbon liquids including, but not limited to diesel, gasoline, heating oil, alcohols, and military fuels such as JP8.

The evaporative burner of the present invention may be used in Stirling engines, particularly small (<3 kWe) Stirling engines, thereby expanding the versatility of such engines and improving the portability of small Stirling engine applications. A small evaporative burner may have applications in other small continuously fired power sources such as fuel cells and external combustion heat engines such as Steam engines. In addition, the evaporative burner as disclosed may be used in other applications requiring a small burner, for example, heating small spaces such as truck and boat cabins and small heating applications such as glass and ceramic kilns.

Referring to FIG. 1, a cross-sectional view of a burner 10 including a recuperative heat exchanger 160, an evaporation chamber 120, reverse throat 130, combustion chamber 140, and Stirling heater head 180 in accordance with preferred embodiments of the invention, is shown and designated generally by numeral. The evaporative burner 10 includes among other components, a swirler 100, an evaporation chamber 120, a reverse throat 130, an igniter assembly 110, a flame monitoring device 150, recuperative heat exchanger 160, and a combustion chamber 140.

Figure 1A:
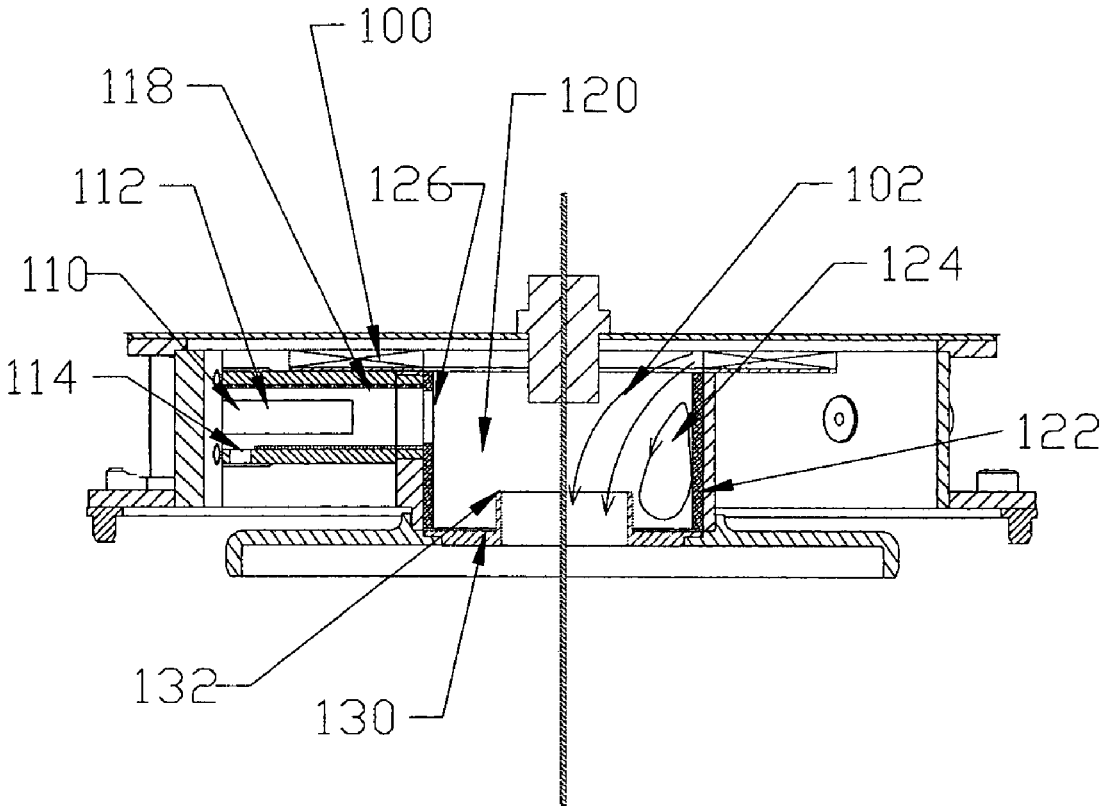
FIG. 1A shows the cross sectional view of the evaporation chamber of the evaporative burner.

As shown in FIGS. 1 and 1A, the combination of the swirler 100, evaporation chamber 120 and reverse throat 130, act to create a stabilized rich flame inside the evaporation chamber that allows the burner to evaporate a significant amount of fuel shortly after ignition. Enough fuel is evaporated in the evaporation chamber that the subsequent burning in the combustion chamber is enough to bring the Stirling engine to full power in a relatively short time after the ignition. The radial swirler 100 imparts a tangential velocity to the air entering the evaporation chamber 120. The reverse throat 130 forces most of the air entering the evaporation chamber to draw to the center and exit through the opening of the throat. Some of the entering air recirculates near the evaporative surfaces of the lining 122. After an initial period of heating by the igniter, a self-sustaining flame forms in the recirculation zone 124. The fuel rich flame in the recirculation zone 124 produces the heat to evaporate and partially combust fuel from the porous metal lining 122. The fuel-rich partially combusted burner fuel-air mixture then mixes with the rest of the air flowing through the reverse throat 130. The resulting lean mixture then ignites and burns in the combustion chamber 140. Once the main airflow is sufficiently heated by the recuperative heat exchanger 160, the preheated air may evaporate the fuel directly from the porous metal on the chamber walls, with or without a flame at recirculation zone 124.

The igniter can be switched off once the flame is established in the recirculation zone 124 to reduce the electrical draw of the burner. Alternatively, the igniter may be left on to burn the widest possible fuel-air mixture as the burner heats up.

Reverse Throat

Referring to FIG. 1A, the reverse throat 130, separating the combustion chamber from the evaporation chamber, has raised ends 132 that protrude into the evaporation chamber. The optimal dimensions of the protrusion, and the diameter of the reverse throat, in relation to the dimensions of the evaporation chamber and the swirler, facilitate the formation of the recirculation zone 124 in the evaporation chamber. In addition, the reverse throat 130 and the swirler 100 control the form of the main combustion flame brush. Preferably, the reverse throat has a height that is 40% of the throat diameter. In a specific embodiment, the reverse throat 130 has a diameter of 0.62 inches and the height of the raised ends 132 of the throat is 0.27 inches. The reverse throat 130 is preferably made of inconel 625 or other high temperature alloys.

The dimensional correlations of the other burner components with respect to the reverse throat may affect the formation of the recirculation zone 124 and the flame shape in the combustion chamber 140. The evaporation chamber 120 in the preferred embodiment has a diameter that is 2.25 times larger and a height that is 1.4 larger than the reverse throat diameter.

Evaporation Chamber

With reference to FIG. 1 and 1A, in order to provide even heating around the inner row of tubes in the Stirling heater head 180 the fuel should be evaporated from the majority of the surface of the evaporation chamber 120. The swirling air flow provides additional mixing and smoothing in variations in fuel-air ratio. If the rate of evaporation is too high, all the fuel may evaporate near where it is added, that is, at the ignition assembly/evaporation chamber joint 126. Conversely, if the rate of mixing of the evaporated fuel and air is too low, the burner power may be limited. Additionally, very low mixing may prevent a flame from forming in the recirculation zone 124 altogether.

The walls of the evaporation chamber 120 are constructed of material, preferably metal, to allow the air to be contained in the chamber and mix with the fuel. The walls of the chamber include a socket to accommodate the igniter assembly. The interior walls of the evaporation chamber are lined with a material, preferably porous metal, which acts as a wick to distribute fuel around the chamber. In a preferred embodiment, the evaporative lining is a porous metal 122 formed from metal particles pressed and sintered together. The preferred material is porous Inconel 600 sold by the Mott Corporation. Alternatively, other porous metals such as, Stainless steel 316L, Hastalloy C76 and Hastalloy X could be used. Alternative materials for the wick include woven metal screen and random metal fibers or some combination of these. The evaporation chamber lining 122 serves two primary purposes. First, it ensures that the fuel is not readily evaporated around the area surrounding the fuel feed and thus uniformly distributed throughout the chamber. Second, the lining 122 encourages gradual and uniform evaporation of the fuel to generate a relatively homogenous and optimal fuel-air mixture for a steady and uniform flame in the combustion chamber. Similarly, rapid evaporation of the fuel in the lining would result in evaporating all the fuel near the fuel tube and fuel source and thus create a non-uniform flame in the combustion chamber. A non-uniform flame or any flame focused in one section of the heater tubes may produce lower average head temperatures and thus lower engine power and efficiency.

Combustion Chamber

As shown in FIG. 1, the combustion chamber 140 is downstream of the reverse throat 130. The main combustion event occurs in a swirl-stabilized flame. The combustion chamber may be designed based on the requirements of the application, although the preferred combustion chamber size has a diameter that is at least 1.7 and a length that is at least 4.8 times the reverse throat diameter.

Igniter Assembly.

The igniter assembly 110, comprising the igniter 112, an air port 114 and a fuel port 116, is in communication with the evaporation chamber 120 via a socket as shown in FIG. 1A. The interior walls of the assembly, except the air and fuel ports, may have a lining 118. Preferably, the lining can be made of a material such as a Stainless steel screen 118. Alternatively, the lining can be made of other high temperature metal screens, porous metal or random fibers. The screen 118 acts as a wick to facilitate the uniform distribution of the fed fuel throughout the igniter assembly 110. The igniter may be an excitable hot surface igniter 112 that may reach temperatures greater than 1150° C. When excited, the high temperature of the igniter first evaporates the fuel and then ignites it. In a preferred embodiment, the igniter is an excitable glow pin 112. Alternatively, the igniter may be a ceramic hot surface igniter.

Air for combustion in the igniter assembly may enter the assembly via an air port 114. In a preferred embodiment, the diameter of this air port 114 relative to the flow paths through the swirler 100 is important in affecting the easy of ignition and warm-up of the burner 10. The size of the air port 114 may control the fuel-air ratio in the igniter and the speed of the torch flame exiting the igniter assembly. A relatively large air port may permit too much air to flow through the igniter assembly to stabilize a flame at the exit. Conversely, a relatively small opening at the air port 114 may create an air flow that is too low such that the resulting fuel-air mixture will be too rich to ignite. Preferably, the airflow through the igniter assembly should be such that the exiting velocity of air is between 1–3 times the flame speed of a fuel-air stoichiometric mixture, which is about 40 to about 120 cm/sec at ambient temperatures. In addition, the fuel-air equivalent ratio in the igniter should be between about 2 and about 6. In the preferred embodiment, these requirements require an air port opening size of between 0.11 and 0.14 inches in diameter.

Figure 2:
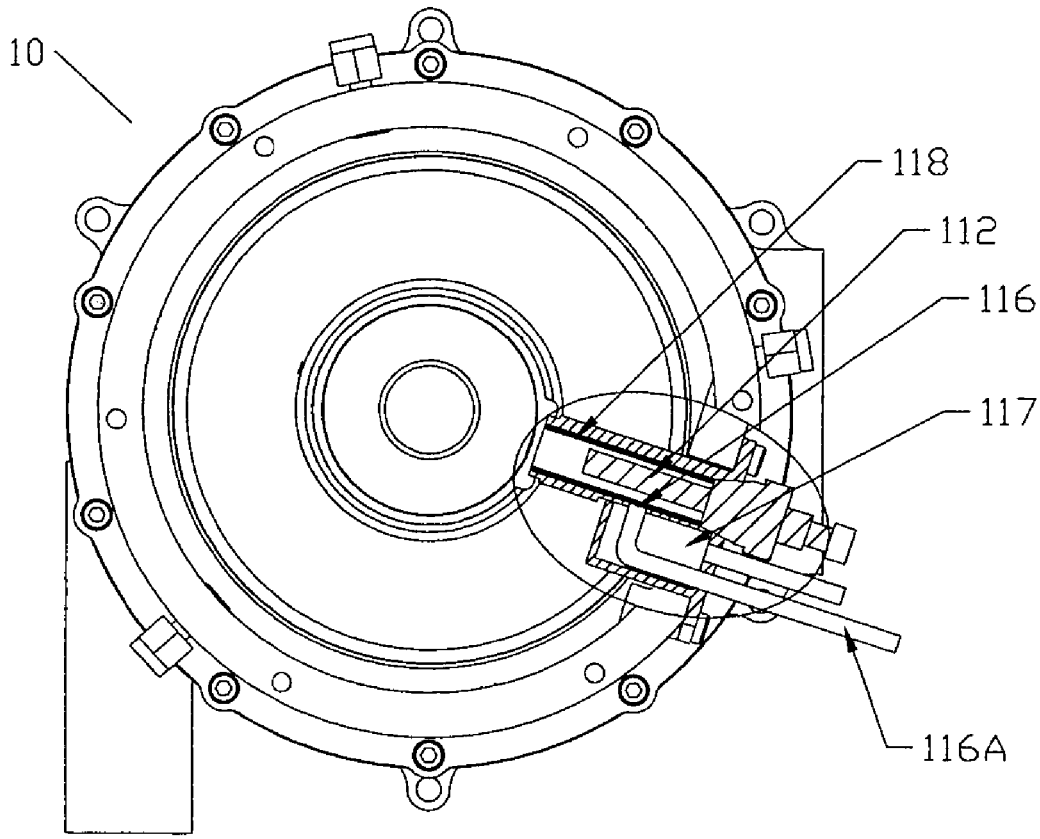
FIG. 2 shows a top view of an embodiment of the evaporative burner where the fuel to the igniter assembly is water-cooled.

Fuel for combustion in the igniter assembly may enter the assembly via a fuel port 116. The temperature of the fuel to the burner may be changed before it is delivered. A temperature varying means such as air, water, or gaseous heating or cooling method may achieve the change in temperature. Referring to FIG. 2, which shows a preferred embodiment, the fuel flows via a water-cooled fuel tube 116A into the screen 118 of the igniter assembly. The water for the water bath 117 for cooling the fuel tube 116A is supplied via a water line 117A. Generally, the fuel flows along screen 118 into the evaporation chamber lining 122, where it evaporates. If the igniter is energized, some or all of the fuel may evaporate and burn in the torch flame present in the combustion chamber. The rest of the fuel may then flow into the lining 122.

The preferred embodiment shows fuel distributed through the ignition assembly. Alternatively, the main fuel line could be directly connected to the evaporation chamber lining 122. In this configuration, a separate fuel line could supply fuel directly to the igniter assembly. The main fuel line may be advantageously oriented across from the igniter assembly to improve fuel distribution around the evaporation chamber.

Figure 3:
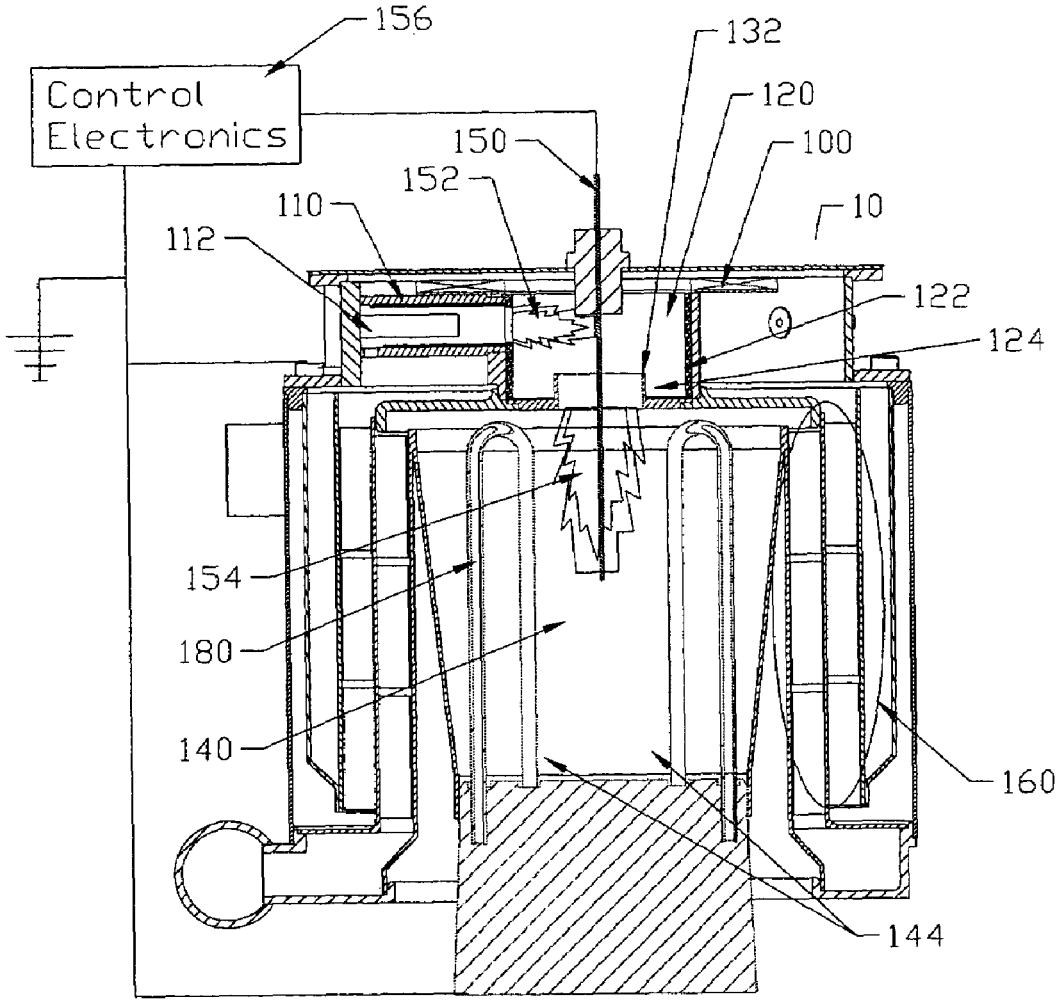
FIG. 3 shows a cross sectional view of an embodiment of the evaporative burner with the flame rectification monitoring device.

Referring to FIG. 3, the above described igniter assembly in the burner operates as follows: The excitable ignition glow pin is energized and allowed to heat up. Air is fed through the igniter assembly air port 114 while fuel is fed through the fuel port 116 and distributed through the assembly 110. The igniter 112 ignites internally to generate a long torch flame or pilot flame 152 that extends into the annular space of the evaporation chamber 120. The pilot flame 152 provides the initial thermal energy to evaporate the fuel in the evaporation chamber. Fuel that does not evaporate in the igniter assembly flows into the evaporation chamber. Eventually enough fuel fills the lining 122 such that a self-sustaining flame forms in the recirculating zone 124 next to the walls. The igniter and fuel to the igniter assembly may then be switched off or left on during the warm-up cycle to maintain combustion despite transients in the fuel-air equivalence ratio.

Flame Monitoring Device

Other embodiments of the invention include a flame-monitoring device. The flame-monitoring device provides a signal in the presence of a flame. For the safe operation of the any burner it is important that the fuel be shut-off in the event of a flameout.

In a preferred embodiment as shown in FIG. 3, the monitoring device for flame sensing is the flame rectification method using a control circuit 156 and a flame rod 150. Flame rectification is the preferred flame sensing approach for the small, high efficiency bumers, including all gaseous and liquid fuel burners used in Stirling engines.

As shown in FIG. 3, the device uses a single flame rod 150 to detect both the ignition pilot-flame 152 and the main combustion flame 154. The flame rod 150, relatively smaller than the grounded heater head 180 or burner 10, and it is positioned within both the igniter pilot flame 152 and the main combustion flame 154. Under these two conditions, when the control unit 156 applies an alternating current between the flame rod 150 and heater head 180, a flame, if present in the chamber will conduct and rectify the current, resulting in a pulsating direct current. Accordingly, when the control unit 156 detects a pulsating direct current, it may conclude that a flame is present in the chamber. Conversely, if the control unit 156 detects an alternating current, it may conclude that no flame is present and it may shut down the associated components to maximize the burner efficiency. In addition, if no current is detected, or the current falls below a specified level, the control unit may determine that there is no flame present or the flame is of poor quality and the control unit subsequently shut down or attempt to light the igniter again. In this flame rectification embodiment, the control unit electronics are manufactured by Kidde-Fenwal, Inc., and the flame rod is commercially available from International Ceramics and Heating Systems Swirler Referring to back to FIGS. 1 and 1A, the swirler 100, upstream to the interior of the evaporation chamber 120, directs air into the chamber 120. The swirl flow of directed air combined with the geometry of the raised ends of the reverse throat 130 and the evaporation chamber 120 facilitate the recirculation of the air in the recirculation zone 124.

Figure 4:
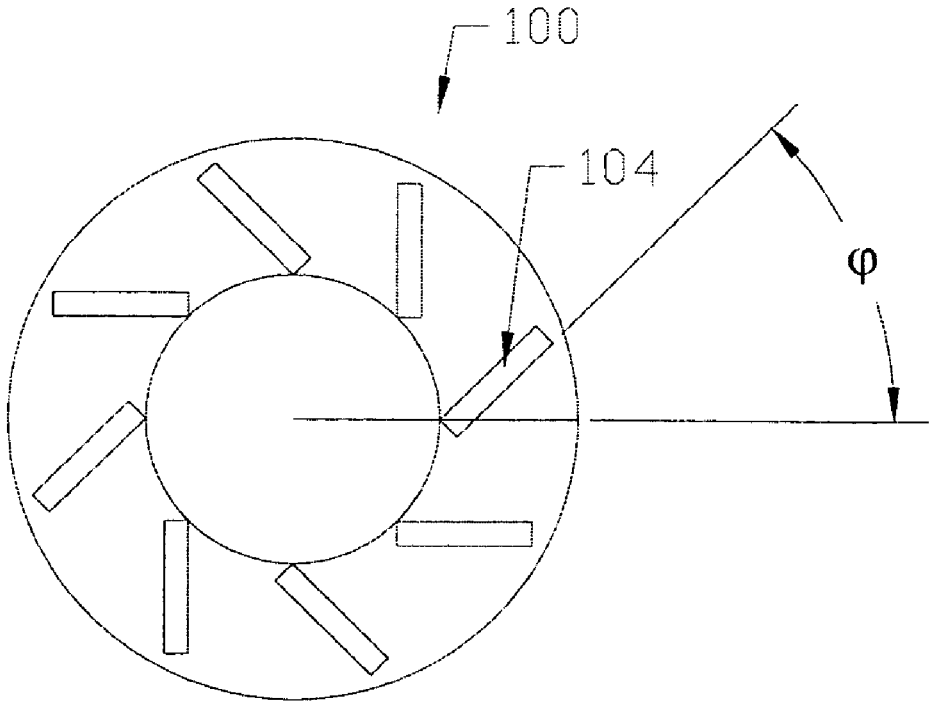
FIG. 4 shows the top view of a swirler that is part of the evaporative burner in FIGS. 1–3.

The preferred embodiment, as shown in FIG. 4, has a swirler comprising eight vanes 104 of ⅛-inch bar stock set at an angle $\phi$, where $\phi$ is 45°. This arrangement produces sufficient turbulence near the evaporation chamber walls to evaporate enough fuel to rapidly heat the heater head 180. Furthermore, this preferred arrangement of the swirler vanes 104 produces adequate turbulence such that there is uniform and not localized evaporation throughout the chamber. Subsequently, the resulting flame is not concentrated on one section of the heater head.

Recuperative Heat Exchanger

Other embodiments of the invention include a recuperative heat exchanger 160. The heat exchanger may change the temperature of the air that is directed into the evaporation chamber 120. In a preferred embodiment, as shown in FIG. 1, the heat exchanger is a preheater 160 that heats the air that is directed into the evaporation chamber. The preheated air may mix with the fuel in the evaporation chamber or combustion chamber as described above.

All of the systems and methods described herein may be applied in other applications besides the Stirling or other thermal cycle engine in terms of which the invention has been described. The described embodiments of the invention are intended to be merely exemplary and numerous variations and modifications will be apparent to those skilled in the art. All such variations and modifications are intended to be within the scope of the present invention as defined in the appended claims.

What is claimed is:

1. An evaporative burner for combusting fuel from a fuel supply and air from an air supply, the fuel and air combined to form a fuel-air mixture, the evaporative burner comprising:

a. a swirler for feeding air into the burner;

b. an evaporation chamber connected to the swirler for receiving air and fuel, the evaporation chamber including a socket for accommodating an igniter assembly, the evaporation chamber characterized by inside walls;

c. an igniter assembly coupled to the evaporation chamber, the igniter including an air port and a fuel port, the assembly for igniting the fuel-air mixture in the evaporation chamber; and d. a reverse throat coupled to the evaporation chamber with raised ends, the raised ends reaching into the evaporation chamber.

2. The evaporative burner of claim 1, wherein the raised ends of the reverse throat stabilize a flame near the evaporation chamber walls.

3. The evaporative burner of claim 1, further comprising a recuperative heat exchanger.

4. The evaporative burner according to claim 1, wherein a porous metal lines the inside walls of the chamber.

5. The evaporative burner of claim 1, further comprising a fuel temperature varying means coupled to the burner.

6. The evaporative burner of claim 1, wherein the dimensions of the igniter assembly air port are correlated to the dimensions of the reverse throat and swirler, to balance the air flow through the igniter assembly air port and the air directed by the swirler such that a Fuel-Air Equivalence ratio from about 2 to about 6 is achieved in the igniter.

7. The evaporative burner of claim 1, wherein the dimensions of the igniter assembly air port are correlated to the dimensions of the reverse throat and swirler, to balance the air flow through an igniter assembly air port and the air directed by the swirler such that an exiting velocity of a flame from the igniter into the evaporation chamber is between about 40 to about 120 cm/sec.

8. An evaporative burner engine system including the evaporative burner of claim 1, further comprising an external combustion heat engine.

9. An evaporative burner engine system including the evaporative burner of claim 1, further comprising a Stirling cycle engine.

10. The evaporative burner of claim 1, wherein the igniter assembly comprises:

a. a material lining the interior of the assembly, wherein the material distributes the fuel throughout the assembly; and b. an excitable igniter for igniting the fuel-air mixture in the assembly to form a flame.

11. The evaporative burner of claim 10, wherein the material lining the interior of the igniter assembly is a screen.

12. The evaporative burner of claim 1, the swirler including vanes.

13. The evaporative burner of claim 12, wherein the swirler includes at least eight vanes.

14. The evaporative burner of claim 1, further comprising a combustion chamber coupled to the evaporation chamber by the reverse throat for receiving a flame from the evaporation chamber.

15. The evaporative burner of claim 14, further comprising a flame rectification monitoring device.

16. The evaporative burner of claim 14, further comprising a recuperative heat exchanger.

17. An evaporative burner engine system including the evaporative burner of claim 16, further comprising an external combustion heat engine.

18. An evaporative burner engine system including the evaporative burner of claim 16, further comprising a Stirling cycle engine.

19. A method for stabilizing a flame in an evaporative burner, the burner including an evaporative chamber and an igniter assembly coupled to the chamber, the method comprising:

a. providing a reverse throat with raised ends reaching into the evaporative chamber for retaining the flame in the chamber;

b. supplying fuel and air to the chamber; and c. igniting the flame in the chamber using the igniter assembly, the flame evaporating the fuel.

* * * * *